United States Patent [19]

Howlett

[11] Patent Number: 5,037,013

[45] Date of Patent: Aug. 6, 1991

[54] DISPENSING APPARATUS FOR PRESSURIZED DISPENSER CONTAINERS

[75] Inventor: David J. Howlett, Norfolk, United Kingdom

[73] Assignee: Bespak PLC, King's Lynn, United Kingdom

[21] Appl. No.: 430,341

[22] Filed: Nov. 2, 1989

[30] Foreign Application Priority Data

Nov. 2, 1988 [GB] United Kingdom ..... 8825632

[51] Int. Cl.[5] ..... B65D 83/14

[52] U.S. Cl. ..... 222/402.2; 222/402.24

[58] Field of Search ..... 222/402.19, 402.20, 222/402.24; 251/342, 348, 354

[56] References Cited

U.S. PATENT DOCUMENTS

| | | | |
|---|---|---|---|
| 3,185,356 | 5/1965 | Venus, Jr. | 222/394 |
| 3,591,059 | 7/1971 | Stearns | 222/402.2 |
| 4,362,257 | 12/1982 | Shay | 222/402.2 |
| 4,858,790 | 8/1989 | Howlett | 222/402.2 |
| 4,953,759 | 9/1990 | Schmidt | 222/402.24 |

FOREIGN PATENT DOCUMENTS

| | | |
|---|---|---|
| 307127 | 3/1989 | European Pat. Off. . |
| 1298425 | 6/1962 | France . |
| 864694 | 4/1961 | United Kingdom . |
| 872187 | 7/1961 | United Kingdom . |
| 1327800 | 8/1973 | United Kingdom . |
| 2050303 | 1/1981 | United Kingdom . |

*Primary Examiner*—Michael S. Huppert
*Assistant Examiner*—Philippe Derakshani
*Attorney, Agent, or Firm*—Beveridge, DeGrandi & Weilacher

[57] ABSTRACT

Dispensing apparatus (1) for dispensing a liquid product (24) from a pressurized dispensing container (21) comprises a collapsible chamber metering valve (2) in which an elastomeric sleeve (4) overlays an external surface (53) of the valve body (6) to define a metering chamber (7) therebetween and is collapsible on actuation of the valve into substantially conformal contact with the external surface such that a volume of liquid is dispensed which is equal to the volume of liquid displaced from the metering chamber. The valve is nestably received within a cup (3) with seal means (15) operable between the mouth of the cup and an outer end of the valve such that a closed collecting chamber (11) is defined between the valve and the cup. Means (25) are provided to communicate in use between the collecting chamber and that part of the container in which a liquid product is contained when the container is held in a predetermined orientation for operation of the valve. The apparatus allows accurate doses of liquids to be dispensed using compressed gas propellant such as nitrogen.

12 Claims, 5 Drawing Sheets

DISPENSING APPARATUS FOR PRESSURIZED DISPENSER CONTAINERS

This invention relates to dispensing apparatus for dispensing a liquid product from a pressurised dispensing container where it is required to dispense an accurately metered quantity of liquid product.

Pressurised dispensing containers have been used for dispensing a wide variety of liquid products and in the past have typically employed a liquid propellant mixed with the liquid product such as a hydrocarbon or fluorocarbon having a sufficiently high vapour pressure at normal working temperatures to propel the liquid product through the dispensing apparatus. The use of such liquid propellants however is now known to create environmental and safety hazards. Alternative dispensing apparatus such as metering pumps have been adopted to avoid the use of propellants altogether but there are a number of inherent disadvantages with such pumps since they generally require the user to depress an actuator having a long dispensing stroke and relatively high actuation force. The accuracy of the metered dose in a metering pump is generally found to be less than in the case of a metering valve used with a pressurised dispensing container for which the valve actuator generally has a short stroke with low actuating force. For certain applications such as dispensing medicaments the accuracy of the metered dose is very important.

There have therefore recently been attempts to make use of pressurised dispensing containers with metering valves and using compressed gas propellants which are gaseous at normal working temperatures and pressures. Such compressed gas propellants include nitrogen.

According to the present invention there is disclosed dispensing apparatus for dispensing a liquid product from a pressurised dispensing container comprising a collapsible chamber metering valve in which an elastomeric sleeve overlays an external surface of the valve body to define a metering chamber therebetween and is collapsible on actuation of the valve into substantially conformal contact with the external surface such that a volume of liquid is dispensed which is equal to the volume of liquid displaced from the metering chamber, a cup within which the valve is nestably received, seal means operable between the mouth of the cup and an outer end of the valve such that a closed collecting chamber is defined between the valve and the cup and means communicating in use between the collecting chamber and that part of the container in which a liquid product is contained when the container is held in a predetermined orientation for operation of the valve.

In referring to the "outer end" of the valve the intended meaning is that the valve end which is outermost with respect to the container in use.

Preferably the apparatus is adapted for dispensing from a container in an upright orientation in which the valve is uppermost and the communicating means comprises a dip tube extending from the cup to the lowermost part of the container.

Alternatively the apparatus may be adapted for dispensing from a container in an inverted orientation in which the valve is lowermost and wherein the communicating means comprises one or more apertures in the cup wall adjacent the cup mouth. An advantage of this arrangement is that a greater proportion of a liquid product can be dispensed than has hitherto been possible.

Conveniently the valve includes a radially outwardly projecting annular flange at its outer end, the cup includes a radially outwardly projecting annular flange adjacent its mouth and wherein a sleeve includes a radially outwardly projecting flange which is compressed between the valve flange and the cup flange to thereby constitute the seal means.

Conveniently the valve and cup are received within a ferrule through which an actuator stem of the valve extends and the cup is maintained in sealing relationship with the valve by a crimped formation of the ferrule.

Conveniently the apparatus is assemblable with the container by crimping the ferrule into engagement with a lip of the container and includes further seal means operable between the cup flange and container lip.

Preferably the valve body defines an internal chamber and defines channel means communicating between the internal chamber and the collapsible chamber, there being provided an axially slidable valve actuating stem extending coaxially through the internal chamber, outlet valve means operable between the stem and the body at the outer end of the internal chamber so as to dispense liquid therefrom in an open condition of the valve and inlet valve means operable between the body and the stem at the inner end of the internal chamber to admit liquid thereto in a closed condition of the valve wherein the inlet valve means comprises an annular seal portion of the sleeve co-operating with an inner end portion of the stem extending through the seal portion.

The elastomeric sleeve in such an arrangement serves not only to form the metering chamber but to cooperate with the valve stem to provide the inlet valve means. This simplifies the construction and assembly of the apparatus.

Preferably the sleeve further comprises an annular shoulder portion nestably receiving the inner end of the body, the shoulder portion and the seal portion being integrally formed of relatively thick and thin material respectively whereby the shoulder portion and seal portion are relatively rigid and flexible respectively so as to positively locate the sleeve upon the valve body whilst permitting deformation of the seal portion.

An advantage of this arrangement is that the seal portion can be made sufficiently flexible to allow manufacturing tolerances to be relaxed with respect to the relative positions of the stem and the seal portion. The shoulder portion can also be made sufficiently rigid that the sleeve is positively held in a static position on the valve body so that there is a higher degree of isolation between the flexure of the seal portion and flexure of the collapsible side walls of the sleeve which define the metering chamber. The side walls, the shoulder portion and the seal portion may therefore be integrally formed without the disadvantage of interaction in the operation of the inlet valve means and the collapsible chamber. A further advantage is that the sleeve is readily mouldable in a single simple operation.

Preferably the channel means comprises a slot in the body extending axially from the inner end of the body into communication with the collapsible chamber, at least the inner end portion of the slot extending radially into the internal chamber to provide a flowpath between the collapsible chamber and a location in the internal chamber adjacent to the inlet valve means.

An advantage of such a slot is that the flow path it provides enables the collapsible chamber to be refilled with fluid passing through the inlet valve means directly into the collapsible chamber via the slot when the valve is in the closed condition. This arrangement is distinguished from prior art arrangements in which the refill flow path takes an indirect path from the inlet valve means, along the length of an internal chamber and then through an access port into the collapsible chamber. The present arrangement thereby provides faster refilling of the metering chamber. A further advantage is that the slot is easily mouldable as a feature of the body since it does not require the use of radially moving moulding tools.

Preferably the seal portion of the sleeve comprises a tubular projection having a radially inwardly directed annular rib of part circular cross-section.

An advantage of such a rib is that friction between the seal portion and the stem is reduced to thereby provide smoothness of operation.

Particular embodiments of the present invention will now be described by way of example only and with reference to the accompanying drawings of which:

Figure 1:
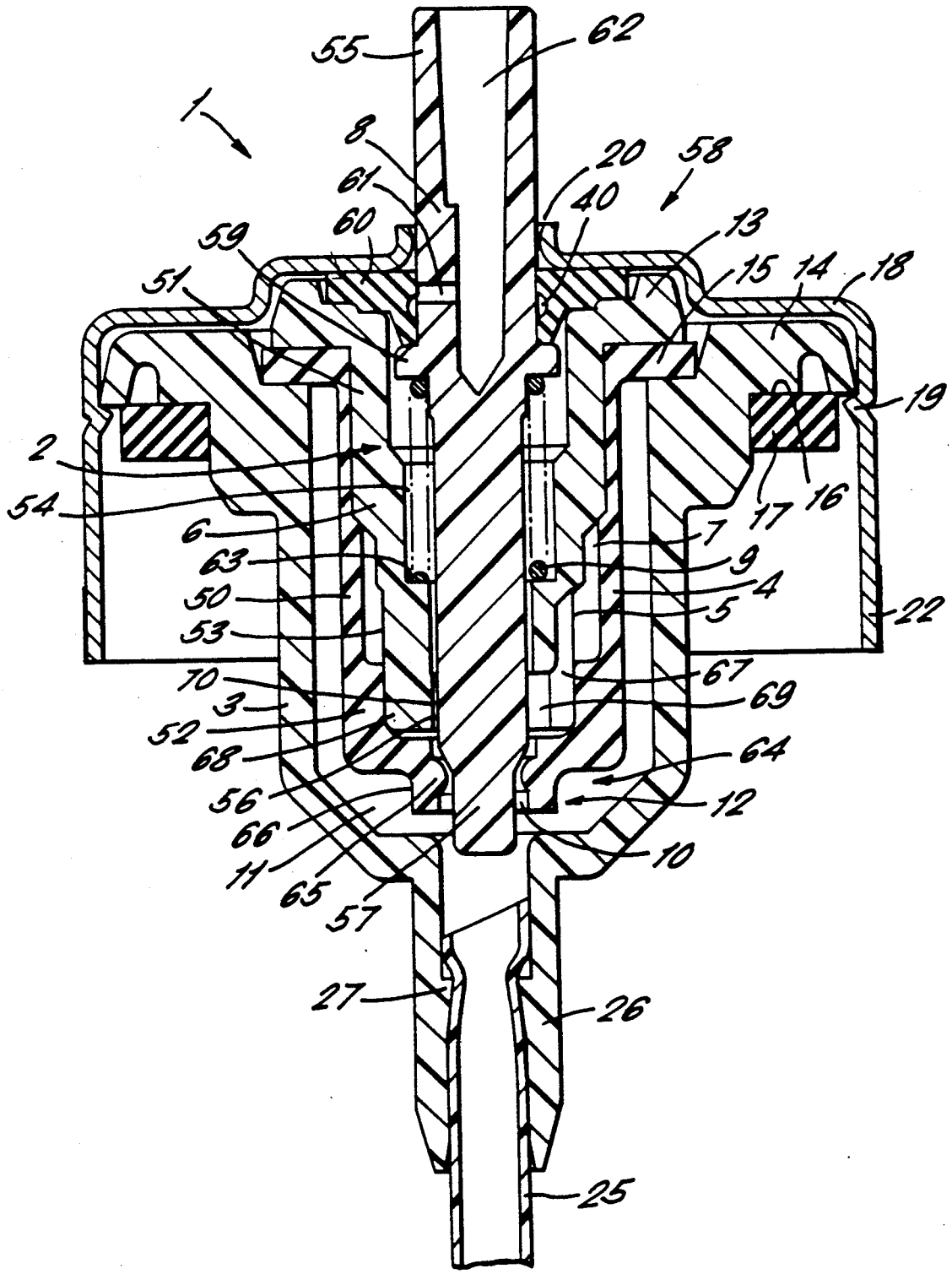
FIG. 1 is a sectional elevation of dispensing apparatus adapted for use with an upright container.
Figure 2:
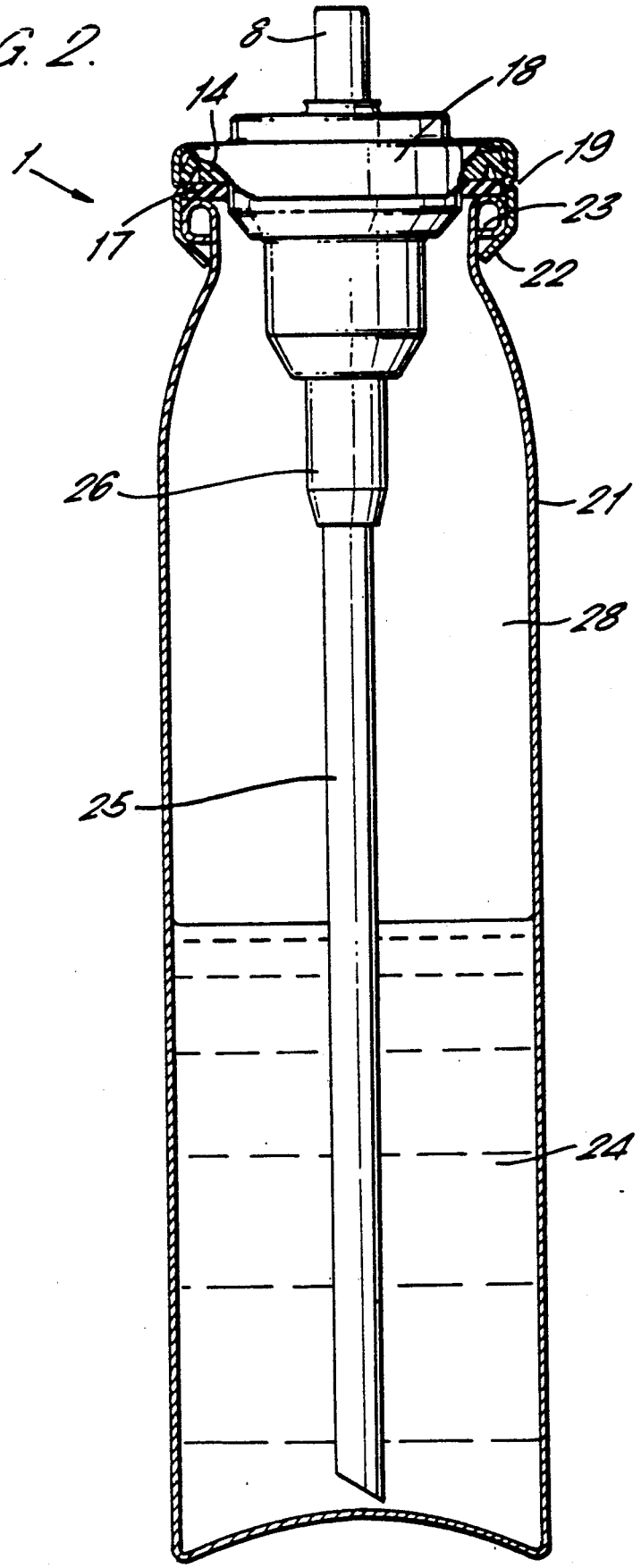
FIG. 2 is a part sectioned elevation of the apparatus of FIG. 1 in combination with a container.

In FIG. 1 a dispensing apparatus 1 comprises a valve 2 which is nestably received within a cup 3 formed of a rigid plastics material. The valve 2 is of the metering type in which an elastomeric sleeve 4 overlays an external surface 5 of a body 6 of the valve such that an annular metering chamber 7 is defined therebetween. The valve 2 is fitted in use to a pressurised dispensing container 21 as shown in FIG. 2 for dispensing liquid 24.

The valve 2 is actuated by manual depression of a valve stem 8 which is reciprocatable axially within the body 6 and the operation of the valve is such that at each depression of the stem a volume of liquid equal to the contents of the metering chamber 7 is discharged through the stem. The stem is returned to its rest position by pressure of a return spring 9 at which time the metering chamber 7 is replenished by an influx of liquid which enters the valve 2 through an inlet opening 10 at the innermost end 12 of the valve with respect to the container 21.

The external surface 5 is stepped in diameter so as to progressively decrease in size in the inward axial direction with respect to the container 21. The elastomeric sleeve 4 has a tubular side wall 50 which coaxially overlays the body 6. The sleeve 4 fits sealingly around an outer end 51 of the valve body 6.

An annular shoulder portion 52 is formed by a thickening of the sleeve material such that the shoulder portion extends radially inwardly of the side wall 50 into contact with an inner end 68 of the valve body 6. Because of the stepped taper of the external surface 5 the annular metering chamber 7 is defined between the sleeve 4 and a portion 53 of the external surface located intermediate the outer end 51 and the inner end 68 of the valve body 6. The shoulder portion 52 is contoured to nestably receive the inner end 68 of the valve body 6 and in this way the sleeve 4 is positively located in coaxial alignment with the body.

The annular metering chamber 7 is thereby closed at its innermost end with respect to the container 21 by the annular shoulder 52.

The body 6 defines an internal chamber 54 which extends axially from an opening 20 through which an outer end 55 of the stem 8 extends and an inlet aperture 56 through which an inner end portion 57 of the stem extends. An outlet valve means 58 is formed in the opening 20 by a radially outwardly projecting annular flange 59 of the stem 8 cooperating with an annular elastomeric seal 60 which is held in sealing contact with the body 6 by a ferrule 18. The seal 60 includes an annular recess 40 halfway along its axial extent. The purpose of the recess 40 is to reduce the contact area between the stem 8 and the seal 60 in order to minimise friction of forces which would otherwise impede the smooth operation of the valve 2. A radially extending bore 61 of the stem 8 communicates with an axially extending outlet channel 62 within the stem, the bore being disposed outside of the internal chamber 54 in the closed condition of the valve 2 as shown in FIG. 1 in which the position of the stem is such that the bore is overlaid by the seal 60. The seal 60 not only prevents leakage of liquid from the internal chamber 54 around the stem 8 when the valve 2 is closed but also prevents the bore 61 from communicating directly with the atmosphere. This prevents any deterioration of the liquid trapped in the stem 8 when the apparatus is not in use and also prevents leakage for drain back from the stem onto the exterior of the ferrule 18. The stem 8 is biassed outwardly by a helical spring 9 held in compression between the flange 59 of the stem and a shoulder 63 formed in the internal chamber 54.

An inlet valve means 64 comprises a tubular extension 66 of the sleeve 4 having a radially inwardly projecting rib 65 which is dimensioned to provide a sealing fit around the stem 8 when the valve 2 is open (and the inlet valve means 64 is closed). The inner end portion 57 of the stem 8 is reduced in diameter such that an annular opening 10 is formed between the stem and the rib 65 when the valve 2 is in a closed condition as shown in FIG. 1 (and therefore the inlet valve means 64 is in an open condition).

An axially extending slot 67 is formed in the inner end 68 of the body 6 and the slot extends axially to a greater extent than the annular shoulder portion 52 of the sleeve so as to communicate with the annular metering chamber 7. The slot 67 has an inner end portion 69 which extends radially into communication with the internal chamber 54 at a location which is adjacent to the inlet valve means 64. The internal chamber 54 is of reduced diameter at this location but axially extending spacer ribs 70 are provided within the internal chamber 54 and project radially inwardly to maintain clearance between the stem 8 and the internal chamber walls. The spacer ribs 65 also serve to maintain the stem 8 in axial alignment with the valve body 6.

The sleeve flange 15, the side wall 50, the shoulder portion 52 and the extension 66 on the sleeve including the rib 65 are all integrally formed of an elastomeric material which may be a natural or synthetic rubber or may be a thermoplastic elastomer. The radial thickness of the shoulder 52 is 1.4 mm compared with the much thinner thickness on the extension 66 which is 0.5 mm. Consequently the shoulder 52 is relatively rigid whereas the extension 66 is relatively flexible. The rib 65 projects radially inwardly by 0.54 mm from the extension 66. The radial thickness of the side wall 50 is 0.55 mm so that the side wall is relatively flexible. This flexibility allows the annular metering chamber 7 to be collapsible by radially inward deformation of the side wall 50. The rib 65 is of semi-circular cross-section and in its relaxed state has an internal diameter which is slightly less than the diameter of the stem 8 but greater than the diameter of the inner end portion 57 of the stem.

The valve 2 is actuated by depressing the stem 8 so as to move inwardly with respect to the container 21 such that the bore 61 communicates with the internal chamber 54 to thereby open the outlet valve means 58. In this condition the depressed stem 8 makes sealing contact with the rib 65 of the extension 66 such that the inlet valve means 64 is closed. Penetration of the stem 8 through the rib 65 is accommodated by resilient deformation of the extension 66.

The cup 3 is generally cylindrical in shape and of larger internal diameter than the external diameter of the sleeve 4 such that an annular collecting chamber 11 is defined between the cup and the valve 2. The collecting chamber 11 extends around the inner end 12 of the valve 2 such that the metering chamber 7 is replenished from liquid drawn from the collecting chamber 11.

The valve body 6 has a radially projecting valve flange 13 at its upper end which extends above a radially extending annular cup flange 14 of the cup 3. A radially projecting annular sleeve flange 15 formed integrally with the elastomeric sleeve 4 is sandwiched between the cup flange 14 and the valve flange 13 so as to provide sealing action between the valve body 6 and the cup 3. The upper end of the collecting chamber 11 is thereby closed.

The cup flange 14 has an under surface 16 against which a gasket 17 is held in place by a ferrule 18 within which the valve 2 and cup 3 are located, the ferrule including an annular crimped formation 19 which retains the gasket, the cup, the sleeve and the valve in their respective assembled positions. The stem 8 projects through an opening 20 in the ferrule 18.

As shown in FIG. 2 the apparatus 1 is fitted on to a container 21 in the form of a roll topped can by crimping a lower portion 22 of the ferrule 18 around a lip 23 of the container such that the lip is sealed to the cup flange 14 by action of the gasket 17.

The cup 3 communicates with liquid 24 contained in the lower part of the container 21 by means of a dip tube 25 which is received within an axially depending tubular extension 26 of the cup. The dip tube 25 is retained within the extension 26 by means of a ramped internal rib 27 which is arranged to indent and grip the dip tube as shown in FIG. 1.

In use the dispensing apparatus 1 is assembled with the container 21 as shown in FIG. 2 and the container partially filled with liquid 24. The head space 28 above the liquid 24 is pressurised with nitrogen gas. Operation of the valve 2 is by depression of the stem 8 which will generally receive an actuator (not shown) having a nozzle providing the desired spray characteristics. The valve requires a number of initial priming strokes to fill the dip tube, the collecting chamber 11 defined by the cup 3 and the internal cavities of the valve 2 including the metering chamber 7.

After priming, depression of the stem 8 actuates the valve 2 into its open condition in which the internal chamber 54 is vented to atmospheric pressure and the flow of liquid commences from the internal chamber through the bore 61 to be dispensed through the outlet channel 62. This reduction of pressure within the internal chamber 54 is communicated through the slot 67 to the annular metering chamber 7 so that a pressure differential is established across the side wall 50 which collapses radially inwardly towards the body 6 thereby displacing liquid from the metering chamber through the slot and into the internal chamber. An equilibrium condition will then be reached in which further deformation of the side wall 50 is prevented by contact with the body 6 and the flow of liquid is then stopped. The valve stem 8 is then released and returned under spring pressure to its normal position as shown in FIG. 1 and in doing so closes the outlet valve means 58 and opens the inlet valve means 64. The side wall 50 then relaxes to its cylindrical undeformed shape and in doing so creates suction within the metering chamber 7. A refill flow path is at the same time established from within the container 21, through the opening 10 around the inner end portion 57 of the stem, into the internal chamber 54 at a location adjacent to the inlet valve means 64 and through the slot 67 to recharge the metering chamber with liquid. An equlibrium condition will then be reached in which pressure is equalised on either side of the side wall 50 and the refill flow is then stopped. The valve is then ready for further actuation.

Figure 3:
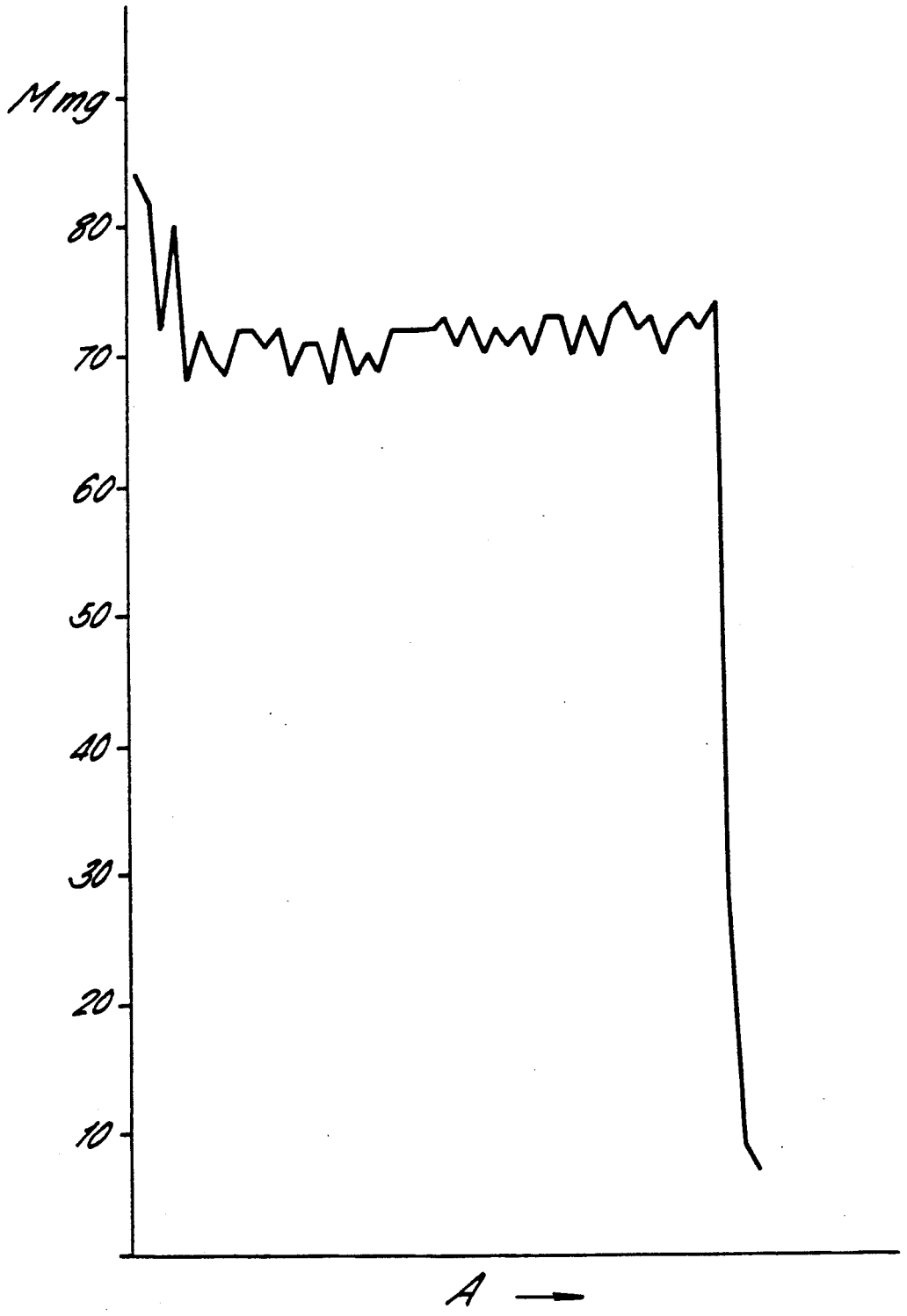
FIG. 3 is a graph of metered dose against the number of actuations obtained using the apparatus of FIGS. 1 and 2.

Repeated actuation of the valve 2 will result in the reservoir of liquid 24 being depleted and the gas contained in the head space 28 expands to fill the volume of the container 21. The gas pressure therefore decreases as the liquid 24 becomes depleted. It has been found that the metered quantity dispensed at each actuation remains substantially unchanged by this depletion in gas pressure as shown in FIG. 3 which is a graph showing the mass M of each liquid dose dispensed against the number of successive actuations A. The sudden drop off in dispensed mass corresponds to exhaustion of the liquid within the container. These results were obtained using an initial fill of 33% at a pressure of 8.5 bar. The average mass dispensed at each actuation is seen to be approximately 70 milligrams.

Figure 4:
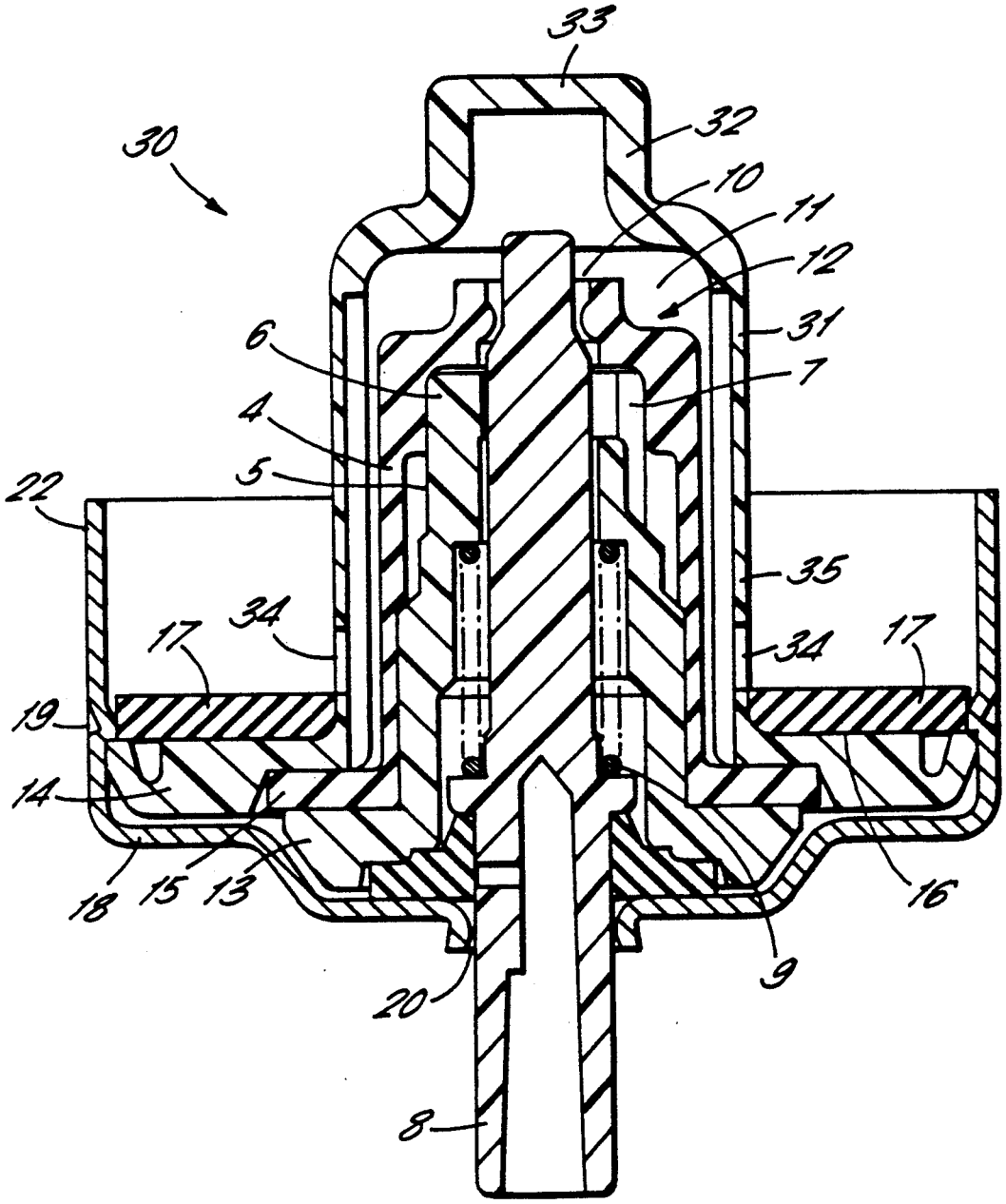
FIG. 4 shows an alternative dispensing apparatus adapted for dispensing from a container in an inverted orientation.

An alternative apparatus 30 is shown in FIG. 4 which will be described with corresponding references to those used in FIGS. 1 and 2 where appropriate.

The apparatus 30 is adapted for dispensing liquid from a container 21 which is inverted in use such that the valve 2 is lowermost. The apparatus 30 has a modified cup 31 in which a tubular extension 32 has a closed end 33. Apertures 34 are provided in the side wall 35 of the cup closely adjacent to the gasket 17 so that in the inverted position as shown in FIG. 4 any residual product liquid within the container is accessible to the apertures thereby ensuring that as much of the liquid as possible is dispensed from the container.

Figure 5:
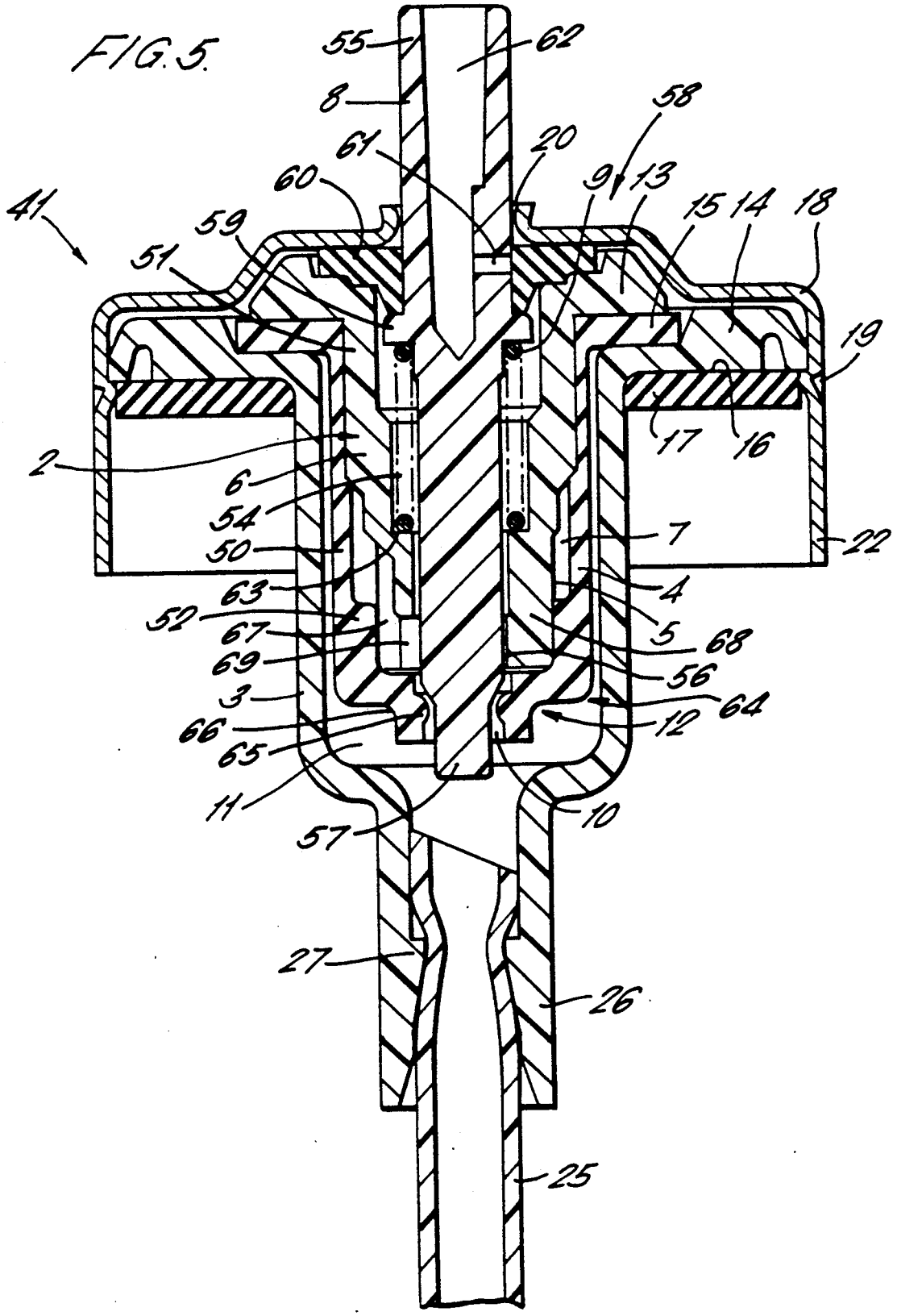
FIG. 5 shows an alternative dispensing apparatus adapted for use with an upright broad rimmed container.

An alternative apparatus 41 is shown in FIG. 5 where corresponding references to those used in FIGS. 1 and 2 are used where appropriate. The apparatus 41 is adapted for dispensing liquid from a container which is upright in use such that the valve 2 is uppermost. The components of the apparatus 41 correspond generally to those of the apparatus 1 of FIG. 1 but the apparatus is dimensioned to engage a broad rimmed container such as a bottle (not shown).

Alternative embodiments of the present invention are envisaged in which alternative collapsible chamber metering valves are contained within a cup as hereinbefore disclosed. The apparatus may be used with relatively insoluble gas propellants such as nitrogen or alternatively with relatively soluble gases such as carbon dioxide. Alternatively the apparatus may be used with conventional aerosol propellants such as hydrocarbons or chlorofluorocarbons (CFC). It is however a particular advantage of this invention that non-hazardous and inexpensive gaseous propellant such as nitrogen can be used without prejudice to the consistency of the metered quantity dispensed.

The invention has application to pharmaceutical and cosmetic products in particular where accurate metered dosage are required.

The apparatus of the present invention may be used with compressed gas propellants other than nitrogen such as carbon dioxide for example.

The apparatus may also be used at relatively low pressures to dispense individual drops of product liquid. If for example eye drops are to be dispensed then an initial fill pressure of 45 psi would typically be used to ensure that only a very low flow rate was dispensed at each actuation of the valve. Other applications where individual drops are to be dispensed would include veterinary use.

The apparatus may be adapted to dispense a dose of medicament in the form of a gel.

What is claimed is:

1. Dispensing apparatus for dispensing a liquid product from a pressurized dispensing container, comprising: a collapsible chamber metering valve in which an elastomeric sleeve overlays an external surface of the valve body to define a metering chamber therebetween, said elastomeric sleeve being collapsible on actuation of the valve into substantially conformal contact with the external surface, such that a volume of liquid is dispensed which is equal to the volume of liquid product displaced from the metering chamber; a cup within which the valve is nestably received; seal means operable between a mouth of the cup and an outer end of the valve, such that a closed collecting chamber is defined between the valve and the cup; and means communicating in use between the collecting chamber and that part of the container in which the liquid product is contained when the container is held in a predetermined orientation for operation of the valve.

2. Dispensing apparatus as claimed in claim 1 adapted for dispensing from a container in an upright orientation in which the valve is uppermost, and wherein the communicating means includes a dip tube extending from a cup to a lowermost part of the container.

3. Dispensing apparatus as claimed in claim 1 adapted for dispensing from a container in an inverted orientation in which the valve is lowermost, and wherein the communicating means comprises one or more apertures in the cup wall adjacent the cup mouth.

4. Dispensing apparatus for dispensing a liquid product from a pressurised dispensing container, comprising:

a collapsible chamber metering valve in which an elastomeric sleeve overlays an external surface of the valve body to define a metering chamber therebetween, said elastomeric sleeve being collapsible on actuation of the valve into substantially conformal contact with the external surface, such that a volume of liquid is dispensed which is equal to the volume of liquid displaced from the metering chamber;

a cup within which the valve is nestably received;

seal means operable between a mouth of the cup and an outer end of the valve, such that a closed collecting chamber is defined between the valve and the cup; and means communicating in use between the collecting chamber and that part of the container in which the liquid product is contained when the container is held in a predetermined orientation for operation of the valve, wherein the valve body includes a radially outwardly projecting annular flange at its outer end, the cup includes a radially outwardly projecting annular flange adjacent the cup mouth, and wherein the sleeve includes a radially outwardly projecting flange which is compressed between the valve flange and the cup flange to thereby constitute the seal means.

5. Dispensing apparatus as claimed in claim 4 wherein the valve and cup are received within a ferrule and wherein the cup is maintained in sealed relationship with the valve by a crimped formation of the ferrule.

6. Dispensing apparatus in claim 5 wherein the apparatus is assemblable with the container by crimping the ferrule into engagement with a lip of the container and including further seal means operable between the cap flange and the container lip.

7. Dispensing apparatus as claimed in claim 1, wherein the valve body defines an internal chamber and the valve body also defines a channel means communicating between the internal chamber and the collapsible chamber, there being provided an axially slidable valve actuating stem extending coaxially through the internal chamber; outlet valve means operable between the stem and the body at the outer end of the internal chamber so as to dispense liquid therefrom in an open condition of the valve; and inlet valve means operable between the body and the stem at the inner end of the internal chamber to admit liquid thereto in a closed condition of the valve, wherein the inlet valve means comprises an annular seal portion of the sleeve co-operating with an inner end portion of the stem extending through the seal portion.

8. Dispensing apparatus as claimed in claim 7 wherein the sleeve further comprises an annular shoulder portion nestably receiving the inner end of the body, the shoulder portion and the seal portion being integrally formed of relatively thick and thin material respectively, whereby the shoulder portion and seal portion are relatively rigid and flexible respectively, so as to positively locate the sleeve upon the valve body whilst permitting deformation of the seal portion.

9. Dispensing apparatus as claimed in claim 7 in which the channel means comprises a slot in the body extending axially from the inner end of the body into communication with the collapsible chamber, at least an inner end portion of the slot extending radially into the internal chamber to provide a flowpath between the collapsible chamber and a location in the internal chamber adjacent to the inlet valve means.

10. Dispensing apparatus as claimed in claim 7, in which the seal portion of the sleeve comprises a tubular projection having a radially inwardly directed annular rib of part circular cross-section.

11. Dispensing apparatus as claimed in claim 1 in combination with a dispensing container, wherein the container contains a quantity of liquid product and a quantity of gaseous propellant, said gaseous propellant being substantially insoluble in the liquid.

12. Dispensing apparatus as claimed in claim 11 wherein the propellant is nitrogen.

* * * * *